United States Patent [19]

Shimoie

[11] Patent Number: 4,541,161

[45] Date of Patent: Sep. 17, 1985

[54] METHOD OF REMODELING CONTROL SECTION OF BACKHOE

[75] Inventor: Shizuo Shimoie, Sakai, Japan

[73] Assignee: Kubota, Ltd., Osaka, Japan

[21] Appl. No.: 547,527

[22] Filed: Oct. 31, 1983

[30] Foreign Application Priority Data

Jul. 22, 1983 [JP] Japan ..... 58-134554

[51] Int. Cl.[4] ..... B23P 7/00; E02F 5/02

[52] U.S. Cl. ..... 29/401.1; 37/103; 37/DIG. 17; 74/469

[58] Field of Search ..... 29/401.1, 402.01, 402.03, 29/402.04, 402.05, 402.06, 402.07, 402.08, 402.09, 402.11, 402.12, 402.13, 402.14, 402.16, 402.18, 402.19; 37/103, DIG. 17; 74/469

[56] References Cited

U.S. PATENT DOCUMENTS 3,283,602 11/1966 Lindell ..... 37/103

*Primary Examiner*—Howard N. Goldberg
*Assistant Examiner*—V. K. Rising
*Attorney, Agent, or Firm*—Edwin E. Greigg

[57] ABSTRACT

A method of remodeling a control section of a backhoe comprising adding a relay unit including relay rotary sleeve shafts and rotary shafts rigidly attached to a carrier base to extend in two parallel rows, and operatively connecting the rotary sleeve shafts and rotary shafts selectively to drive rods which are pushed or pulled by an oscillation in one direction of one of the hand levers, respectively, and to driven rods operatively connected to those of the valves which should be actuated by the drive rods, respectively.

1 Claim, 7 Drawing Figures

METHOD OF REMODELING CONTROL SECTION OF BACKHOE

BACKGROUND OF THE INVENTION

This invention relates to a method of remodeling a control section of a backhoe by which a basic interlocking structure operatively connecting, by a rod interlocking mechanism, two hand levers oscillatable crosswise to four backhoe implement control valves in a particular interlocking relationship to actuate the valve selectively and simultaneously, is remodeled into a modified interlocking structure providing an interlocking relationship different from the particular interlocking relationship, in order to provide a control mode to meet users' requirements.

It has been a conventional practice for remodeling the control section of a backhoe to standardize and equip all vehicles at manufacturing times with relay rotary sleeve shafts and rotary shafts for use in a modified interlocking structure, so that the basic interlocking structure provided at manufacturing times may be replaced with a modified interlocking structure in a simple manner by connecting interlocking rods to these relay shafts at times of shipment in order to meet users' demands. According to such a practice, the vehicles employing the basic interlocking structure which account for a greater part of shipment, are all equipped with the relay shafts as totally unnecessary accessories thereof. Therefore, equipping all the vehicles with the relay shafts as standard parts thereof lowers the manufacturing efficiency and at the same time poses a problem of high manufacturing cost.

SUMMARY OF THE INVENTION

Having regard to the above state of the art, the object of this invention is to provide a rational improvement on the method of remodeling the interlocking structure thereby to facilitate the remodeling word and to avoid unnecessary permanent parts being provided for vehicles.

A method of remodeling the control section of a backhoe as set out in the introductory part hereof and according to this invention characteristically comprises adding a relay unit including relay rotary sleeve shafts and rotary shafts rigidly attached to a carrier has to extend in two parallel rows, and operatively connecting the rotary sleeve shafts and rotary shafts selectively to drive rods which are pushed or pulled by an oscillation in one direction of one of the hand levers, respectively, and to driven rods operatively connected to those of the valves which should be actuated by the drive rods, respectively. The invention as described has the following advantages:

By employing the above improved method, only those vehicles that need remodeling for a modified interlocking structure may be equipped with the relay rotary sleeve shafts and rotary shafts, thereby avoiding unnecessary equipment of the relay shafts for vehicles employing the basic interlocking structure which account for a greater part of shipment. As a result, wasteful parts and assembly processes are now eliminated, which contributes toward a substantial reduction of manufacturing cost and a substantial increase in manufacturing efficiency as a whole.

Moreover, since the rotary sleeve shafts and rotary shafts of the modified interlocking structure are rigidly attached to the carrier base to extend in two parallel rows, to form a relay unit, attachment of the rotary sleeve shafts and rotary shafts to a vehicle at the time of remodeling is completed simply by assembly the relay unit carrying base into the vehicle. The remodeling for the modified interlocking structure is effected with about the same easiness as in the prior art method. Thus, the invention provides a control section remodeling method having great practical advantages of facilitating the remodeling, and yet on the whole excellent in manufacturing efficiency and economy.

Other advantages of the invention will be apparent from the following description.

BRIEF DESCRIPTION OF THE DRAWINGS

The drawings show modes of remodeling the control section of a backhoe according to this invention, in which.

DESCRIPTION OF THE PREFERRED EMBODIMENTS

Figure 1:
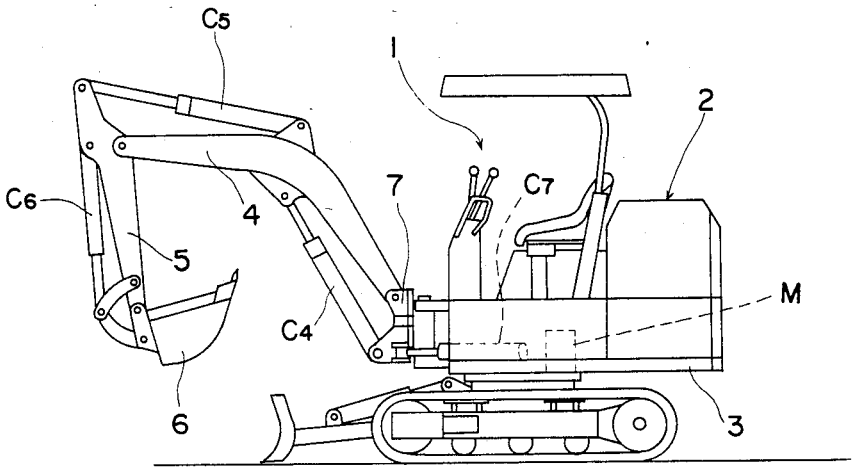
FIG. 1 is a side view of an entire backhoe.

Referring to FIG. 1, a backhoe is shown comprising a driver's section 1 and a prime mover section 2 mounted on a swivel deck 3 swiveled by a hydraulic motor M, and a digging implement including a boom 4, an arm 5 and a bucket 6 which are oscillatable by hydraulic cylinders C4, C5 and C6, respectively. The digging implement is attached to the swivel deck 3 through a swing bracket 7 to be oscillatable by a hydraulic cylinder C7 left and right relative to the swivel deck 3.

Figure 3:
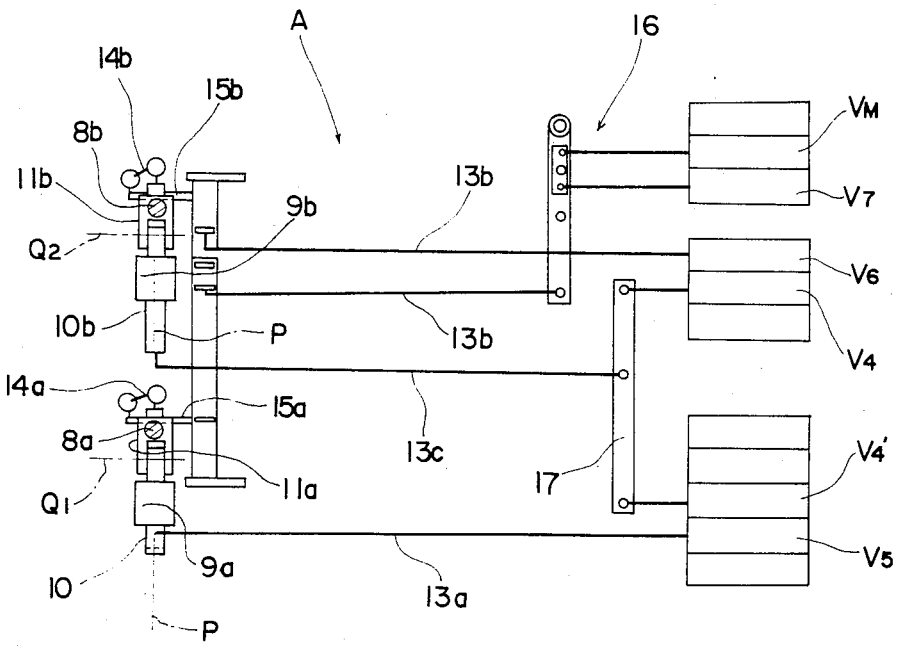
FIG. 3 is a developed view of the basic interlocking structure.
Figure 2:
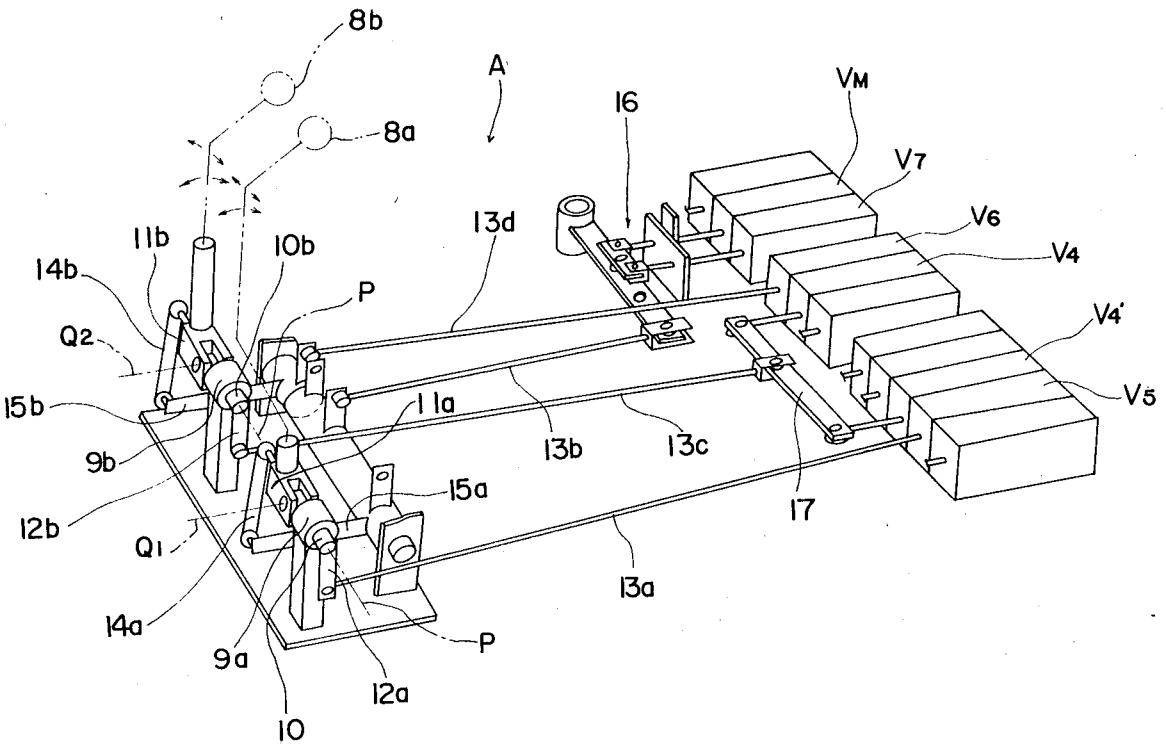
FIG. 2 is a perspective view of a basic interlocking structure.

Referring to FIGS. 2 and 3 showing a structure for controlling the digging implement and the swivel deck 3, a first hand lever 8*a* and a second hand lever 8*b* are connected to a first pivotal boss 9*a* and a second pivotal boss 9*b* coaxially arranged on a swivel deck frame, respectively, through a first and second transverse rotary shafts 10*a* and 10*b* and a first and a second oscillatable elements 11*a* and 11*b*. The first and second osillatable elements 11*a* and 11*b* are connected to the first and second rotary shafts 10*a* and 10*b* to be oscillatable only about longtudinal axes Q1 and Q2, respectively.

The swivel deck frame carries a plurality of valves V arranged transversely thereof. An arm control valve V5 is operatively connected through a first rod 13*a* to a first arm 12*a* secured to the first rotary shaft 10*a*. A swing bracket control valve V7 and a swivel deck control valve VM are operatively connected to the first oscillatable element 11*a* through a vertical rod 14*a*, a first bell crank 15*a*, a second rod 13*b* and a valve selector mechanism 16. A boom control valve V4 is operatively connected through a third rod 13*c* to a second arm 12*b* secured to the rotary shaft 10*b*. A bucket control valve V6 is operatively connected to the second oscillatable element 11*b* through a vertical rod 14*b*, a second bell crank 15*b* and a fourth rod 13*d*.

Thus, the arm 5 is controllable by back and forth oscillations of the first hand lever 8*a* about an axis P of the rotary shaft, and the swing bracket 7 and the swivel deck 3 are selectively controllable by right and left oscillations of the first hand lever 8*a* about the longitudinal axis Q1. The boom 4 is controllable by back and forth oscillations of the second hand lever 8*b* about the axis P of the rotary shaft, and the bucket 6 is controllable by right and left oscillations of the second hand lever 8*b* about the longitudinal axis Q2.

In the drawings, reference V4' denotes a boom drive accelerator valve which is brought into and out of operative connection with the boom control valve V4 by shifting a fulcrum point of a balance arm 17 parallelly connecting the two valves V4' to the third rod 13*c*.

Figure 4:
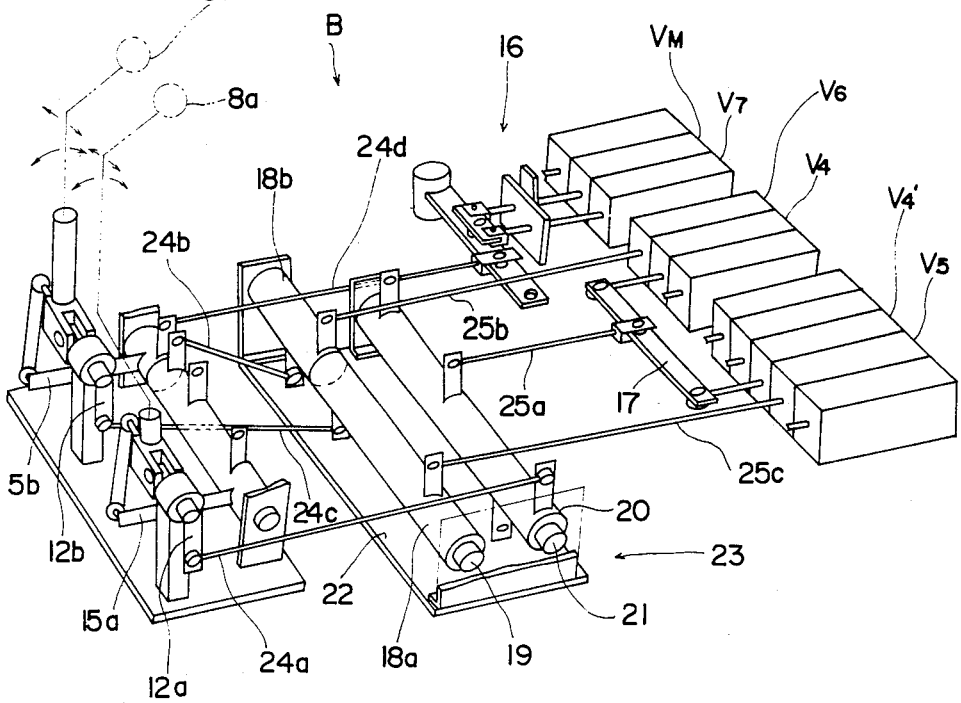
FIG. 4 is a perspective view of a first modification of the interlocking structure.
Figure 5:
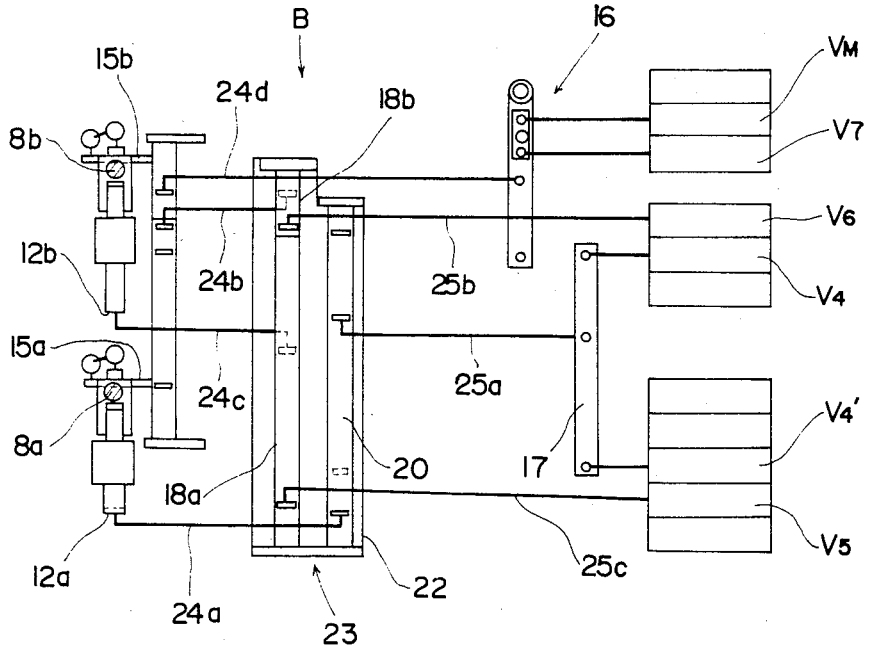
FIG. 5 is a developed view of the first modification of the interlocking structure.

The described basic interlocking structure A is remodeled as shown in FIGS. 4 and 5 to alter the control modes of the first and second hand levers 8*a* and 8*b*. A relay unit 23 is additionally provided on the swivel deck frame between a hand lever supporting portion and the plurality of valves. The relay unit 23 comprises a carrier base 22 to which a first relay shaft 19 and a second shaft 21 are rigidly attached to extend transversely of the vehicle and parallel to each other. The first relay shaft 19 is loosely fitted with a first and second relay sleeve shafts 18*a* and 18*b* carrying rod connecting arms. The second relay shaft 21 is loosely fitted with a third relay sleeve shaft 20 carrying rod connecting arms.

With the four rods 13*a*–13*b* having been removed, the first arm 12*a* and the balance arm 17 for boom control are operatively connected to each other through a first drive rod 24*a*, the third relay sleeve shaft 20 and a first driven rod 25*a*, and the first bell crank 15*a* and the bucket control valve V6 are operatively connected to each other through a second drive rod 24*b*, the second relay sleeve shaft 18*b* and a second driven rod 25*b*. Further, the second arm 12*b* and the control valve V5 are operatively connected to each other through a third drive rod 24*c*, the first relay sleeve shaft 18*a* and a third driven rod 25*c*, and the second bell crank 15*b* and the valve selector mechanism 16 are operatively connected to each other through a fourth drive rod 24*d*.

Thus, the above remodeled arrangement constitutes a first modification of the interlocking structure B in which the boom 4 is controllable by back and forth oscillations of the first hand lever 8*a*, the bucket 6 is controllable by right and left oscillations of the first hand lever 8*a*, the arm 5 is controllable by back and forth oscillations of the second hand lever 8*b*, and the swing bracket 7 and the swivel deck 3 are selectively controllabe by right and left oscillations of the second hand lever 8*b*.

It will be understood that the fourth drive rod 24*d* comprises the same rod used as the second rod 13*b* in the basic interlocking structure A.

Figure 6:
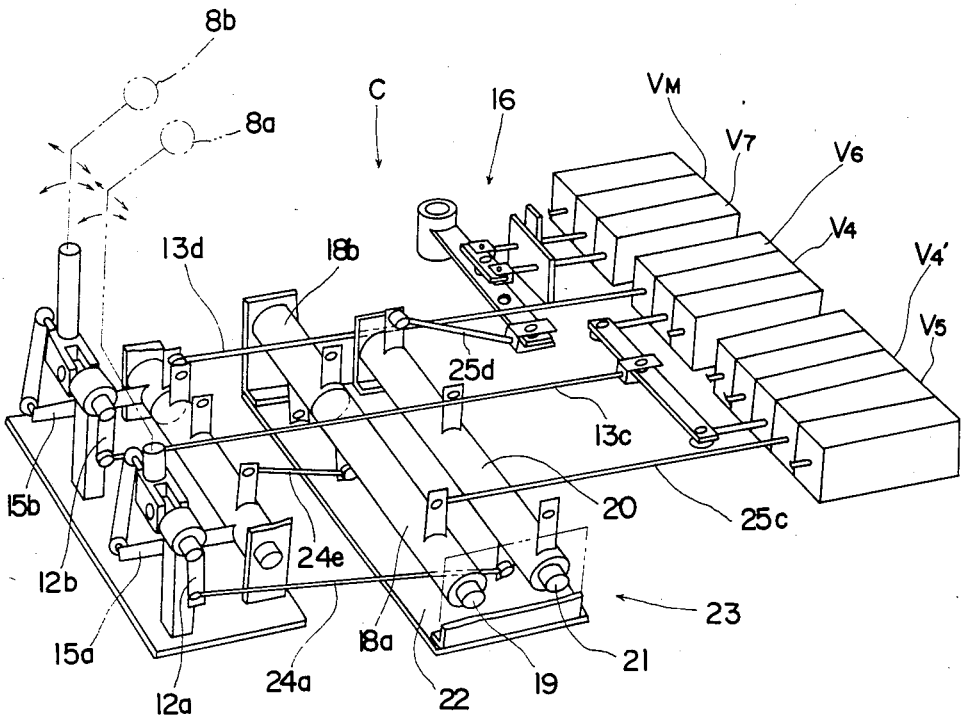
FIG. 6 is a perspective view of a second modification of the interlocking structure.
Figure 7:
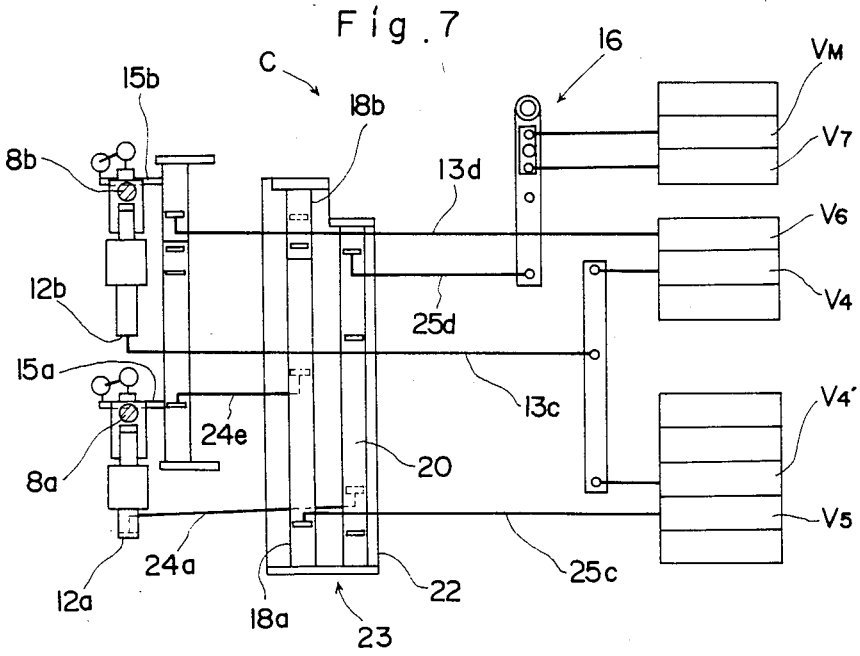
FIG. 7 is a developed view of the second modification of the interlocking structure.

Referring to FIGS. 6 and 7, the basic interlocking structure is remodeled in a different way in which the described relay unit 23 is additionally provided, with the third and fourth rods 13*c* and 13*d* retained and the other rods 13*a* and 13*b* removed.

The first arm 12*a* and the valve selector mechanism 16 are operatively connected to each other through the first drive rod 24*a*, the third relay sleeve shaft 20 and the fourth driven rod 25*d*. The first bell crank 15*a* and the arm control valve V5 are operatively connected to each other through a fifth drive rod 24*e*, the first relay sleeve shaft 18*e* and the third driven rod 25*c*. Thus, the second hand lever 8*b* has the same operational mode as in the basic interlocking structure A, while the first hand lever 8*a* has a different operational mode provided by this second modification C of the interlocking structure in which the swing bracket 7 and the swivel deck 3 are selectively controllable by back and forth oscillations of the first hand lever 8*a* and the arm 5 is controllable by right and left oscillations of the first hand lever 8*a*.

In the second modification C of the interlocking structure, the fourth driven rod 25*d* comprises the same rod used as the third drive rod 24*c* in the first modification B, and the fifth drive rod 24*e* comprises the same rod used as the second drive rod 24*b* in the first modification B.

In summary, the invention provides for simple modifications to meet users' requirements by adding the relay unit 23 and altering rod connections in the interlocking structure.

In addition to the first and second modifications B and C, the interlocking structure may be modified in varied manners utilizing the relay unit 23.

Furthermore, varied improvements may be made in the support structure for the two crosswise oscillatable hand levers 8*a* and 8*b*.

I claim:

1. A method of remodeling a control section of a backhoe by which a basic interlocking structure (A) operatively connecting, by a rod interlocking mechanism, two hand levers (8*a*,8*b*) oscillatable crosswise to four backhoe implement control valves (V4–V7) selectively and simultaneously, is remodeled into a modified interlocking structure (B, C) providing an interlocking relationship different from said particular interlocking relationship, said method comprising adding a relay unit (23) including relay rotary sleeve shafts and rotary shafts (18*a*, 18*b*, 20) rigidly attached to a carrier base (22) to extend in two parallel rows, and operatively connecting said rotary sleeve shafts and rotary shafts (18*a*, 18*b*, 20) selectively to drive rods (24*a*–24*e*) which are pushed or pulled by an oscillation in one direction of one of said hand levers (8*a*, 8*b*), respectively, and to driven rods (25*a*–25*d*) operatively connected to those of said valves (V4–V7) which should be actuated by said drive rods (24*a*–24*e*), respectively.

* * * * *